US010388483B2

(12) United States Patent
Nan et al.

(10) Patent No.: US 10,388,483 B2
(45) Date of Patent: Aug. 20, 2019

(54) PROTECTIVE ELEMENT

(71) Applicant: Nanjing Sart Science & Technology Development Co., Ltd, Nanjing (CN)

(72) Inventors: Shirong Nan, Nanjing (CN); Manxue Yang, Nanjing (CN); Rongbao Zhang, Nanjing (CN)

(73) Assignee: NANJING SART SCIENCE & TECHNOLOGY DEVELOPMENT CO., LTD, Nanjing (CN)

( * ) Notice: Subject to any disclaimer, the term of this patent is extended or adjusted under 35 U.S.C. 154(b) by 0 days.

(21) Appl. No.: 15/118,168

(22) PCT Filed: Feb. 2, 2016

(86) PCT No.: PCT/CN2016/073123

§ 371 (c)(1),
(2) Date: Aug. 11, 2016

(87) PCT Pub. No.: WO2016/127846

PCT Pub. Date: Aug. 18, 2016

(65) Prior Publication Data

US 2016/0372294 A1 Dec. 22, 2016

(30) Foreign Application Priority Data

Feb. 14, 2015 (CN) ..... 2015 1 0077995
Feb. 14, 2015 (CN) ..... 2015 2 0106449 U

(51) Int. Cl.
*H01H 85/175* (2006.01)
*H01H 85/18* (2006.01)

(52) U.S. Cl.
CPC ..... *H01H 85/175* (2013.01); *H01H 85/185* (2013.01)

(58) Field of Classification Search
CPC ..... H01H 85/175; H01H 85/185; H01H 2033/888; H01H 2085/381;
(Continued)

(56) References Cited

U.S. PATENT DOCUMENTS 3,965,452 A * 6/1976 Chabala ..... H01H 85/43 337/280
4,628,291 A * 12/1986 Lien ..... H01H 85/42 204/249

(Continued)

FOREIGN PATENT DOCUMENTS

CN 103730301 A 4/2014
CN 203573925 U 4/2014

(Continued)

OTHER PUBLICATIONS

Li, Ziwei, "Fuse Cutout", Apr. 16, 2014, Wujiang City Dongtai Electric Power Special Switch Co LTD, Entire Document (Full Translation of CN103730301, cited in IDS—including Original Document).*

(Continued)

*Primary Examiner* — Anatoly Vortman
*Assistant Examiner* — Stephen S Sul
(74) *Attorney, Agent, or Firm* — Gokalp Bayramoglu

(57) ABSTRACT

Disclosed is a protective element, comprising an insulator, a fusible element, and electrodes, wherein the insulator covers a meltable part of the fusible element. The electrodes are disposed at two ends of the insulator. Two ends of the fusible element are electrically connected to the electrodes. Wave absorbing structures are disposed around the fusible element in the insulator, a plurality of protrusions is provided on the wave absorbing structures, and the protrusions face the fusible element. Distances exist between the wave absorbing structures and the fusible element. The present invention improves the shape of a fusible element and designs wave absorbing structures which can resist an impact, energy waveforms can be destroyed, impact energy is dispersed to the periphery so as to achieve the aim of wave (energy) absorbing, a breaking performance of a protective element can be at least doubled by virtue of the design of the wave
(Continued)

absorbing structure, a manufacturing process is simple, and the protective element is suitable for batch production.

10 Claims, 10 Drawing Sheets

(58) Field of Classification Search
CPC .... H01H 2085/388; H01H 3/60; H01H 85/38; H01H 85/36; H01H 85/43
USPC ..... 337/228, 248, 273, 222, 280
See application file for complete search history.

(56) References Cited

U.S. PATENT DOCUMENTS 7,498,923 B2 * 3/2009 Iversen ..... H01H 39/006 200/61.08
2004/0183646 A1 * 9/2004 Jollenbeck ..... H01H 85/0418 337/228
2006/0139853 A1 * 6/2006 Daoud ..... H01H 9/042 361/600
2007/0132539 A1 * 6/2007 Richter ..... H01H 85/042 337/14
2016/0172143 A1 * 6/2016 Yoneda ..... H01H 85/08 337/186

FOREIGN PATENT DOCUMENTS

JP 200176611 A 3/2001
JP WO 2015030023 A1 * 3/2015 ..... H01H 85/08

OTHER PUBLICATIONS

Yoneda, Yoshihiro, Suzuki Kazuaki, "Fuse Element and Fuse Device", Mar. 5, 2015, Dexerials Corp, Entire Document (Translation of WO 2015030023).*

* cited by examiner

PROTECTIVE ELEMENT

CROSS-REFERENCE TO RELATED APPLICATIONS

This application is the United States national phase of International Application No. PCT/CN2016/073123 filed Feb. 2, 2016, and claims priority to Chinese Patent Application Nos. 2015100779956 and 2015201064496, both filed Feb. 14, 2015, the disclosures of which are hereby incorporated in their entirety by reference.

BACKGROUND

Technical Field

The present invention relates to the technical field of electrical protective elements, and particularly relates to a protective element capable of improving breaking performance.

Related Art

A protective element is the last defense of safety protection for an electronic product, a safety performance thereof being extremely important. When the protective element is designed, not only it is necessary to consider the compactness of a structure, to ensure its over-current and short-circuit protection performances, and to more strictly require its breaking performance, but also the protective element must be able to resist frequent start/stop and impacts of indirect surges such as thunder and lightning so as to keep the performance stable and effective for a long time in a long-term using process.

Existing protective elements have multiple basic structures, generally speaking, an insulator, a fusible element, and electrodes. When a protective element is instantaneously impacted by a heavy current, an interior temperature of a product sharply raises and expands, the fusible element easily fuses off, quickly breaks through a protective layer of the insulator and jets out. The phenomena of burning, exploding, and the like will occur, and other parts will be polluted. Based on this, existing products have structures for improving breaking capabilities. For example, due to the fact that a cavity is provided around a fusible element of a protective element having a tubular structure, the cavity is usually filled with silicon dioxide or inert gas to improve the breaking capability, or micro holes are provided on a housing to relieve pressure. However, improvement of the performance thereof is limited, and the effect is not ideal. In addition, due to a small size, a chip-type protective element having an existing structure has a poor breaking performance and a poor surge resistance capability.

SUMMARY

In order to solve the above problem, disclosed is a protective element having an improved structure. Wave absorbing structures which can resist an impact are designed in the element, thereby effectively improving a breaking performance of the protective element.

To this end, the present invention provides the technical solution as follows.

A protective element, comprising an insulator, a fusible element, and electrodes, the insulator covering a meltable part of the fusible element, the electrodes being disposed at two ends of the insulator, two ends of the fusible element being electrically connected to the electrodes, and characterized in that wave absorbing structures are disposed around the fusible element in the insulator, and comprise a plurality of protrusions, the protrusions face the fusible element, and distances exist between the wave absorbing structures and the fusible element.

Furthermore, a cavity is provided in the insulator, the meltable part in the fusible element is suspended in the cavity, the wave absorbing structures are a plurality of protrusions disposed on a wall of the cavity, top ends of the protrusions face the fusible element, and distances exist between the protrusions and the fusible element.

Furthermore, the protrusions are conical, truncated cone-shaped, cylindrical, prismatic or cuboid-shaped.

Furthermore, the insulator is a tubular housing.

Furthermore, the insulator comprises an upper insulating layer, an intermediate insulating layer and a lower insulating layer stacked from top to bottom, a through hole is provided in the middle of the intermediate insulating layer, a wall of the through hole, the upper insulating layer and the lower insulating layer form the cavity, and the wave absorbing structures are disposed on a lower end face of the upper insulating layer and/or an upper end face of the lower insulating layer and/or the wall of the through hole.

Furthermore, the insulator comprises an insulating substrate and an insulating protection layer formed on the insulating substrate, the electrodes are formed at two ends of the insulating substrate, the fusible element is formed on a front surface of the insulating substrate, the insulating protection layer covers an area between the electrodes at the two ends of the front surface of the insulating substrate, the wave absorbing structures are at least one wave absorbing band disposed around the fusible element, a plurality of stabs is provided on the wave absorbing band, tips of the stabs face the fusible element, and distances exist between the stabs and the fusible element.

Furthermore, the wave absorbing bands are disposed on an upper side and/or lower side and/or left side and/or right side and/or four corners of the fusible element and/or an own clearance of the fusible element.

Furthermore, a bend of the fusible element is arc-shaped.

Furthermore, a section of thin fusible element is provided in the middle of the fusible element, and the width of the thin fusible element is smaller than the widths of other parts of a body of the fusible element.

Furthermore, the lengths of the wave absorbing band are greater than or equal to a half of the length of a fusible element pattern, and the centers of the two wave absorbing bands correspond to the center of the fusible element.

The beneficial effects are as follows.

In the present invention, wave absorbing structures are disposed around a fusible element, and comprise protrusions facing the fusible element when a protective element is impacted by a heavy current and a high voltage in a using process and the fusible element fuses off to cause a heat energy splash impact. The protrusions in the wave absorbing structures can destroy energy waveforms and disperse impact energy to the periphery so as to achieve the aim of wave (energy) absorbing. Particularly, when the wave absorbing structures are made of metal materials or metal layers cover the protrusions, a metal dense structure can resist and adsorb energy more quickly, and the effect is better. The wave absorbing structures disperse heat impacts simultaneously, avoid breakage of an outermost insulator due to concentration of the heat impacts in one place, prevent molten metal liquid from quickly jetting out and burning to influence the appearance or burn other parts down, and avoid pollution of surrounding components, thereby reducing destroying of a protective layer caused by heat impact energy and rate, and reducing the possibility of jetting out and explosion. A breaking performance of the protective element can be at least doubled by virtue of the design of the wave absorbing structure.

When the protective element has a chip-type structure, the fusible element can be further designed by adopting a bent line corner, the width of each section of the fusible element is uniform, and a break angle does not exist at a turning place. Thus, instantaneous surges can smoothly pass through the fusible element, a bend of the fusible element is difficult to break or fracture, thereby improving a surge resistance capability. In addition, when the chip-type protective element is impacted by indirect lightning surges, even if the fusible element instantaneously fuses off, since two ends of a wave absorbing band approach the electrodes on two sides, the indirect lightning surges act on the fusible element, air around a high-voltage electrified body is ionized, conductive characteristics will be generated, the wave absorbing band continues conduction to be electrically connected to the electrodes on the two sides, currents and voltages of some indirect lightning surges are quickly led to a negative electrode, some energy acting on the fusible element is shunted, and, therefore, the lightning resistance capability of the entire protective element is at least doubled. The present invention is reasonable in structural design, stable in performance, good in safety, lower in cost, simple in manufacturing process, and suitable for batch production.

LIST OF REFERENCE NUMERALS

Figure 1:
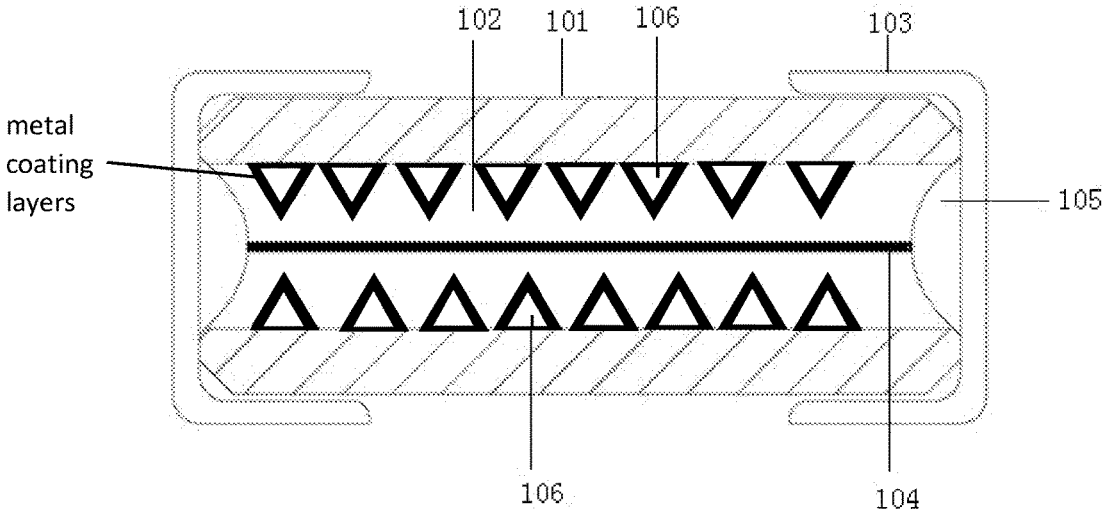
FIG. 1 is a sectional diagram of a protective element having a tubular structure, wherein a sectional line is parallel to an extension direction of a fusible element.

101—insulating housing, 102—cavity, 103—end cap, 104—fusible element, 105—tin solder, 106—protrusion, and 107—pit;

201—upper insulating layer, 202—intermediate insulating layer, 203—lower insulating layer, 204—electrode, 205—groove, 206—through hole, 207—protrusion, and 208—fusible element; and

301—electrode part, 3011—front electrode, 3012—side electrode, 302—fusible element, 303—wave absorbing band, 3031—stab, 304—insulating protection layer, 305—insulating substrate, 306—fusible element connecting part, a—width of fusible element body, c—length of wave absorbing band, and d—length of fusible element pattern.

DETAILED DESCRIPTION

The technical solution provided by the present invention will be illustrated below together with specific embodiments in detail. It shall be understood that specific implementations below are merely intended to illustrate the present invention without limiting the scope of the present invention. It should be noted that terms 'front', 'back', 'left', 'right', 'up' and 'down' used in the following descriptions refer to directions in the drawings, and terms 'inner' and 'outer' refer to directions facing or away from the geometric center of a specific part respectively.

Embodiment 1

Figure 2:
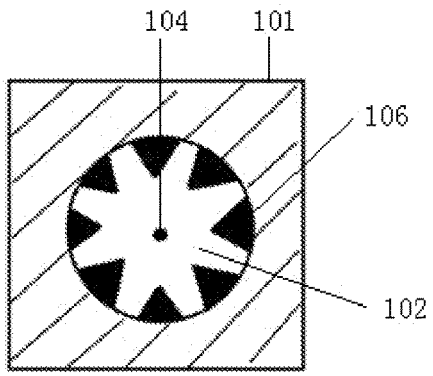
FIG. 2 is a sectional diagram of a protective element having a tubular structure, wherein a sectional line is vertical to an extension direction of a fusible element, and the shape is externally square and internally round.
Figure 3:
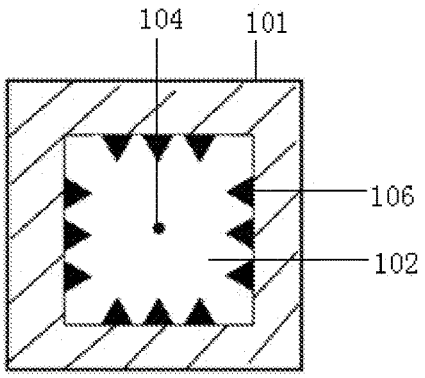
FIG. 3 is a sectional diagram of a protective element having a tubular structure, wherein a sectional line is vertical to an extension direction of a fusible element, and the shape is externally square and internally square.

As shown in FIG. 1, a protective element having a tubular structure comprises a tubular insulating housing 101, a cavity 102 is provided in the housing, a meltable part of a fusible element 104 is suspended (suspending in the present invention referring to that parts, except two ends, of the fusible element are not in contact with an inner wall of the cavity, so that even if the cavity is filled with other materials in contact with the fusible element, the fusible element shall be regarded as suspending) in the cavity, electrodes are disposed at two ends of the housing, the electrodes may be metal end caps 103 shown in FIG. 1 or other conventional structures, and the metal end caps 103 are stably and electrically connected to the fusible element 104 via tin solders 105. It must be pointed out that the tin solders 105 are not necessities. Those skilled in the art can stick the fusible element 104 to the end caps 103 by virtue of glue water or clamp the fusible element 104 by means of tight fit between the end caps 103 and two ends of the tubular housing 101. The fusible element 104 may be set in, but is not limited to, a wire shape or a chip shape, and the shape may be set as, but is not limited to, a linear shape, a curved shape or a winding shape. The shape of the insulating housing 101 can be randomly designed, and the requirements of the present invention can be met as long as the insulating housing 101 is substantially tubular and is internally provided with the cavity 102. In view of process needs, the insulating housing 101 is generally cylindrical or square column-shaped, the section of the cavity 102 may be square, round or oval. As shown in FIG. 2 and FIG. 3, the section of the cavity 102 of the housing may be consistent in shape or different in shape (for example, the section may be externally round and internally square or externally square and internally round). A plurality of wave absorbing protrusions 106 is distributed on an inner wall of the cavity. The wave absorbing protrusions 106 in FIG. 1, FIG. 2 and FIG. 3 have conical structures, tips are provided at the tops, relatively common conical or pyramidal wave absorbing protrusions can be adopted, the tips of the wave absorbing protrusions 106 face the fusible element 104, and wave absorbing cones are not in contact with the fusible element 104. When fusing and breaking, the wave absorbing protrusions 106 (particularly the tips thereon) can well disperse energy waves and heat impacts generated during breaking of the fusible element 104. The wave absorbing protrusions 106 on the inner wall of the cavity 102 shall form a strip, at least, along an extension direction of the fusible element 104 or shall form a circle (vertical to the extension direction of the fusible element) on the inner wall of the cavity 102. Preferably, the wave absorbing cones are uniformly disposed at all positions of the inner wall of the cavity 102, so that wherever the fusible element 104 is broken, the wave absorbing protrusions 106 can achieve a stable dispersion function.

Figure 5:
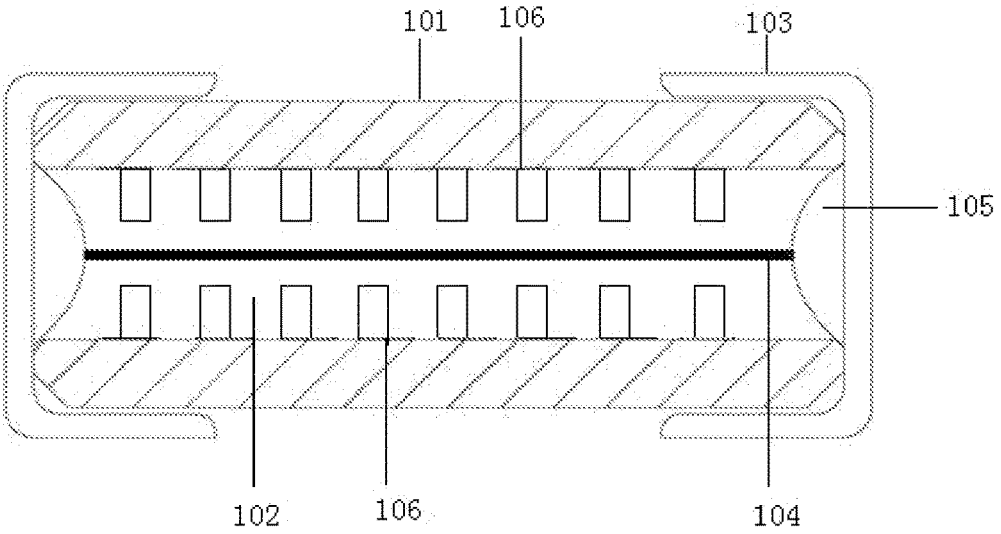
FIG. 5 is a sectional diagram of a protective element having a tubular structure, wherein a sectional line is parallel to an extension direction of a fusible element, and protrusions are cuboid-shaped, cylindrical or prismatic.
Figure 6:
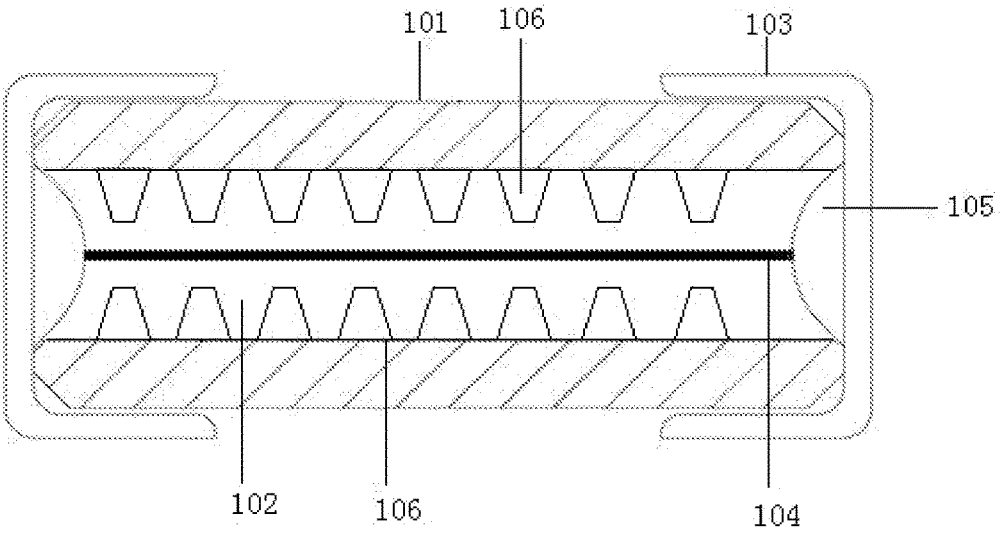
FIG. 6 is a sectional diagram of a protective element having a tubular structure, wherein a sectional line is parallel to an extension direction of a fusible element, and protrusions are truncated cone-shaped.

An experiment shows that when the wave absorbing structures adopt protrusions in other shapes, a dispersion effect can be achieved as long as the top ends thereof face the fusible element 104. In view of machining needs, a regular three-dimensional shape, such as a cuboid shape, a cylinder shape and a prism shape shown in FIG. 5 or a truncated cone shape shown in FIG. 6, is adopted generally. Compared with cuboid-shaped protrusions and cylindrical protrusions, protrusions having small top ends (for example, truncated cone-shaped protrusions) have better effects, dispersion performances are improved by about 15%, and compared with the truncated cone-shaped protrusions, cones having tips at the tops can improve the dispersion performances by about 20%. The sizes of the protrusions on the inner wall of the cavity may be different. For example, the protrusions close to the middle of the cavity are larger, and the protrusions close to two ends of the cavity are smaller. Even protrusions in multiple shapes are probably disposed on the inner wall of the same cavity.

Figure 4:
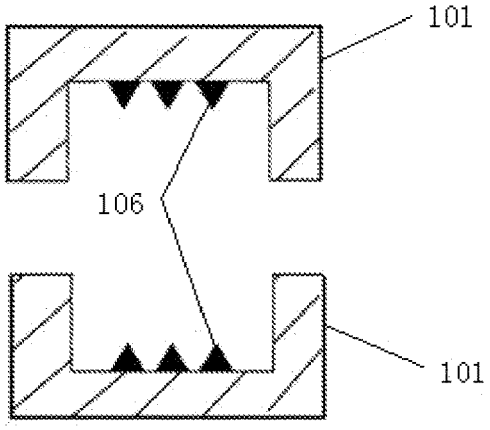
FIG. 4 is a sectional diagram of a protective element having a tubular structure, wherein a sectional line is vertical to an extension direction of a fusible element, and a housing is divided into an upper part and a lower part.
Figure 7:
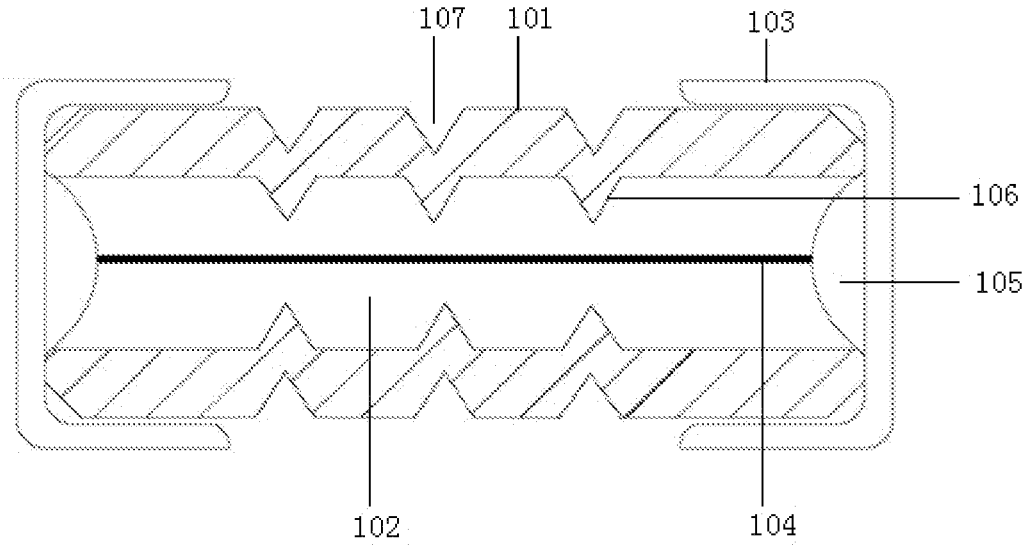
FIG. 7 is a sectional diagram of a protective element having a tubular structure, wherein a sectional line is parallel to an extension direction of a fusible element, and protrusions are formed by pressing pits in an outer wall.
Figure 8:
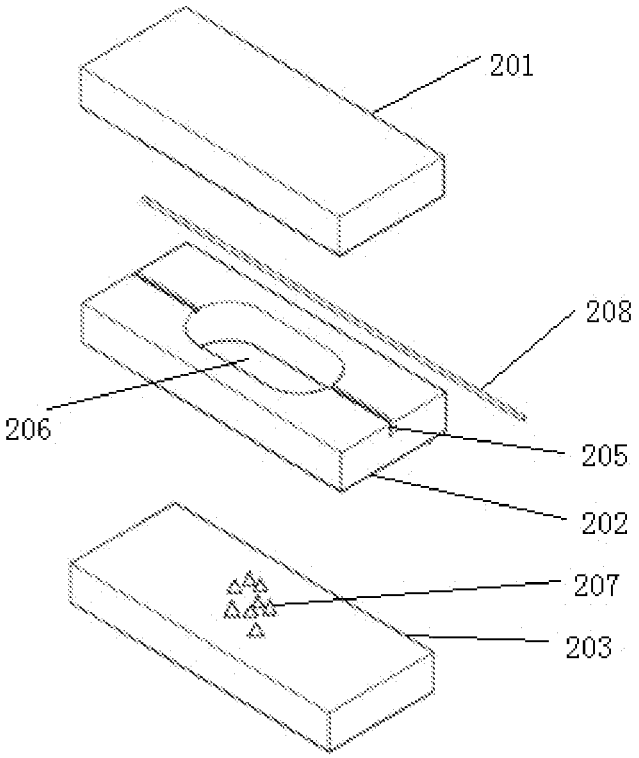
FIG. 8 is a breakdown diagram of each layer of a multi-layer protective element, wherein protrusions are conical.
Figure 9:
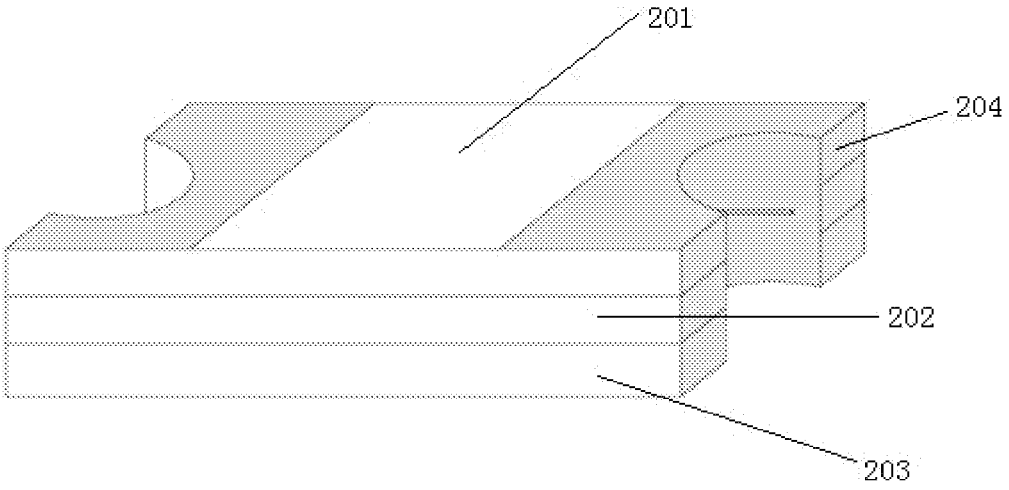
FIG. 9 is an overall structure diagram of a multi-layer protective element.

The wave absorbing protrusions can be integrally molded with the housing by adopting materials identical to a material of the housing when the insulating housing is formed, thereby aiding in the steadiness of a wave absorbing wall. The wave absorbing protrusions can be stuck into the wall of the cavity after the housing is formed. During integral molding, before the housing is not hardened in a manufacturing process of the tubular insulating housing, some pits 107 (as shown in FIG. 7) can be pressed in an outer wall of the tubular housing, thereby forming the wave absorbing protrusions on the inner wall. When the wave absorbing protrusions are formed, metal coating layers are preferably formed on the wave absorbing protrusions, and dense metal materials more aid in resisting and absorbing heat energy and impact energy generated when the fusible element is broken. The tubular insulator housing is preferably made of a high polymer material (such as an FR-4 material) which is extremely easy to machine, the housing can be integrally formed or can be formed by manufacturing an upper U-shaped insulator and a lower U-shaped insulator and then aligning and gluing the two insulators as shown in FIG. 4. Apparently, according to the latter structure, the wave absorbing protrusions can be formed on the wall of the cavity before alignment, thereby making it more convenient to machine.

Embodiment 2

As shown in FIG. 8 to FIG. 11, a protective element having a multi-layer structure comprises an upper insulating layer 201, an intermediate insulating layer 202 and a lower insulating layer 203 from top to bottom, electrodes 204 are disposed at two ends of the upper, intermediate and lower insulating layers, and the electrodes are electrically connected to a fusible element 208. Specifically speaking, the electrodes comprise end electrodes located at two ends of each insulating layer and surface electrodes located on an upper surface of the upper insulating layer and/or a lower surface of the upper insulating layer, and the end surfaces are electrically connected to the surface electrodes. The intermediate insulating layer is disposed between the upper insulating layer and the lower insulating layer, a groove 205 is provided on the intermediate insulating layer, a through hole 206 is longitudinally provided in the middle of the intermediate insulating layer, a wall of the through hole, a lower end face of the upper insulating layer and an upper end face of the lower insulating layer entirely constitute a cavity, the fusible element 208 is disposed in the groove, the middle thereof is suspended in the cavity, and two ends of the fusible element 208 are connected to the electrodes 204. A plurality of wave absorbing protrusions 207 is disposed on the wall of the cavity. The protrusions 207 can be disposed at any one or more of the following positions: the lower end face of the upper insulating layer, the upper end face of the lower insulating layer and the wall of the through hole. The wave absorbing protrusions in FIG. 8 and FIG. 9 have conical structures, tips are provided at the tops, relatively common conical or pyramidal wave absorbing protrusions can be adopted, tips of cones face the fusible element, distances are provided between the cones and the fusible element, and the wave absorbing cones (particularly the tips thereon) can well disperse energy waves and heat impacts generated during breaking of the fusible element. The wave absorbing protrusions on the inner wall of the cavity shall form a strip, at least, along an extension direction of the fusible element 104 or shall form a circle (vertical to the extension direction of the fusible element) on the inner wall of the cavity. Preferably, the wave absorbing cones are uniformly disposed at all positions of the inner wall of the cavity, so that wherever the fusible element 208 is broken, the wave absorbing protrusions can achieve a stable dispersion function.

Figure 10:
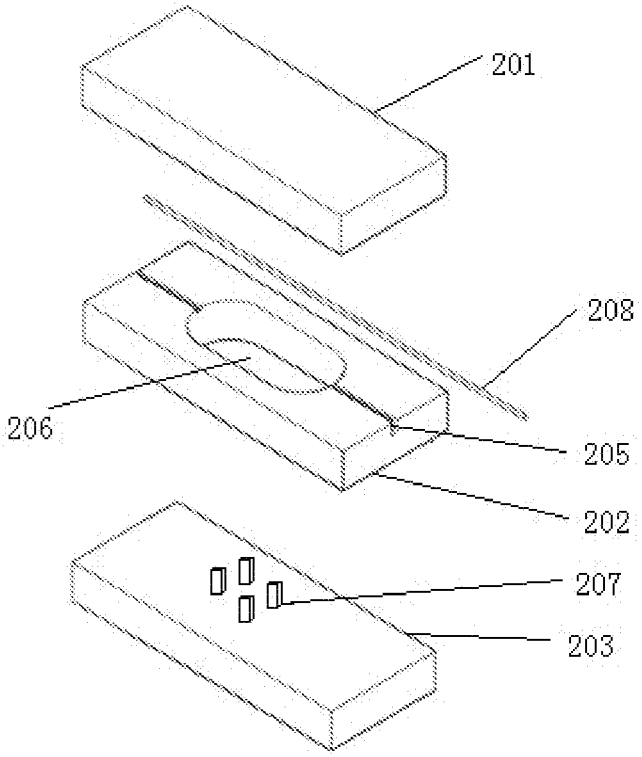
FIG. 10 is a breakdown diagram of each layer of a multi-layer protective element, wherein protrusions are cuboid-shaped.
Figure 11:
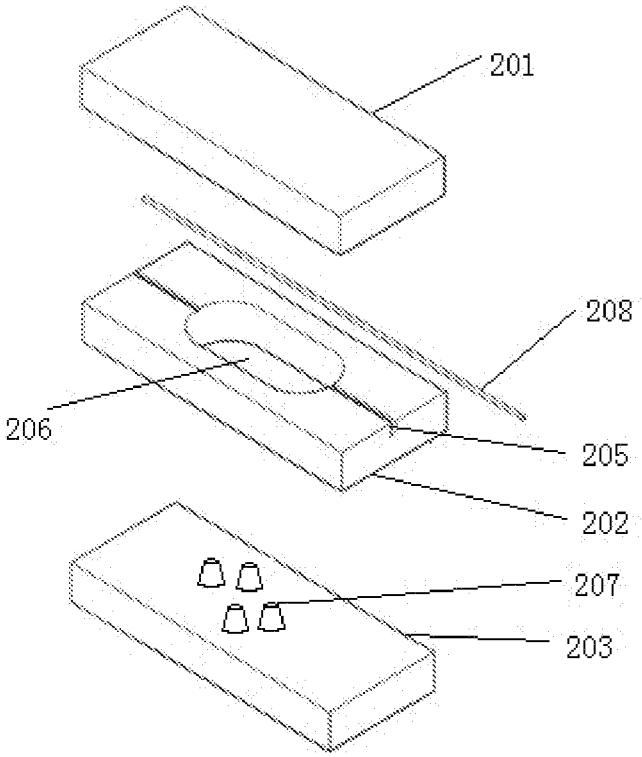
FIG. 11 is a breakdown diagram of each layer of a multi-layer protective element, wherein protrusions are truncated cone-shaped.

Similarly, the wave absorbing structures can adopt protrusions in other shapes such as a cuboid shape, a cylinder shape and a prism shape shown in FIG. 10 or a truncated cone shape shown in FIG. 11. The sizes of the protrusions on the inner wall of the cavity may be different. For example, the protrusions close to the middle of the cavity are relatively large, and the protrusions close to two ends of the cavity are relatively small. Even protrusions in multiple shapes are probably disposed on the inner wall of the same cavity. Similar to a tubular structure, compared with cuboid-shaped protrusions and cylindrical protrusions, protrusions having small top ends (for example, truncated cone-shaped protrusions) have better effects, and cones having tips at the tops have optimal performances.

When the protective element provided by the present embodiment is manufactured, an upper insulating layer, an intermediate insulating layer and a lower insulating layer, having the same size, are manufactured firstly; a longitudinal through hole and a transverse groove are formed in the intermediate insulating layer; the groove penetrates through the through hole; wave absorbing protrusions are formed on a lower end face of the upper insulating layer and/or an upper end face of the lower insulating layer and/or a wall of the through hole; the wave absorbing protrusions can be integrally molded with each insulating layer when the upper insulating layer, the intermediate insulating layer and the lower insulating layer are manufactured; and when the wave absorbing protrusions are formed, metal coating layers are preferably formed on the wave absorbing protrusions, and dense metal materials more aid in resisting and absorbing heat energy and impact energy generated when a fusible element is broken. The fusible element is put into the groove to make the middle thereof suspended in the through hole, after the upper insulating layer and the lower insulating layer cover each other to be closed, the end electrodes are formed on side faces of each insulating layer by electroplating, and the surface electrodes connected to the end electrodes are formed on the upper end face and/or the lower end face of the entire protective element by electroplating as needed. Semicircular grooves are provided at two ends of the protective element manufactured in FIG. 9 so as to better solder, when the protective element is used, to form good electrical connection with a circuit board.

Embodiment 3

As shown in FIG. 12, FIG. 13, FIG. 14 and FIG. 15, a chip-type protective element comprises an insulating substrate 305, electrode parts 301, a fusible element 302 and an insulating protection layer 304, the electrode parts 301 are formed at two ends of the insulating substrate, the insulating protection layer 304 covers an area between electrodes at two ends of a front surface of the insulating substrate, and the electrode parts 301 can be exposed. Specifically speaking, the electrode parts 301 not only cover two end faces of the insulating substrate 305, but also extend to the front surface and back surface (in the present invention, one surface of the insulating substrate shown in FIG. 12 being regarded as the front surface, and the opposite surface being regarded as the back surface) of the insulating substrate 305. The electrode part formed on the front surface of the insulating substrate 305 is called a front electrode 3011, the electrode part formed on the back surface of the insulating substrate 305 is called a back electrode, the electrode parts covering side faces of two ends of the insulating substrate 305 are called side electrodes 3012, and the side electrodes 3012 are configured to be connected to the front electrode and the back electrode. It shall be pointed out that the back electrode is not a necessary structure, and when the protective element is installed with a back surface facing upwards, it is unnecessary to form the back electrode on the back surface of the insulating substrate. The fusible element 302 is formed on the front surface of the insulating substrate, and two ends of the fusible element 302 are electrically connected to the electrode parts 301. One or more wave absorbing bands are disposed around the fusible element 302, stabs 3031 having tips facing the fusible element are provided on the wave absorbing bands 303, the tips of the stabs 3031 face the fusible element 302, and the wave absorbing bands 303 are not in contact with the fusible element 302. When fusing and breaking, the stabs on the wave absorbing bands can well disperse energy waves and heat impacts generated during breaking of the fusible element. Specifically speaking, the fusible element 302 is connected to the electrode parts 301 via fusible element connecting parts 306, and the insulating protection layer 304 needs to cover, an area between two electrodes, over the fusible element 302, the connecting parts 6 and the wave absorbing bands 303.

Figure 12:
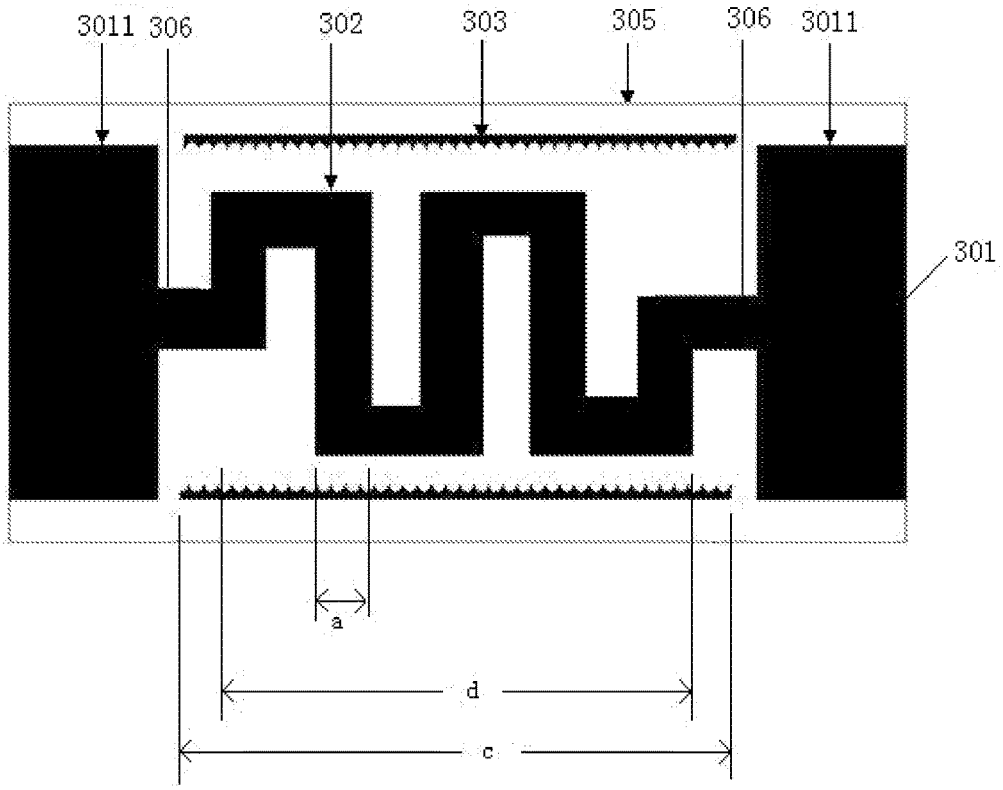
FIG. 12 is a front structure diagram of an insulating substrate in a chip-type protective element.
Figure 13:
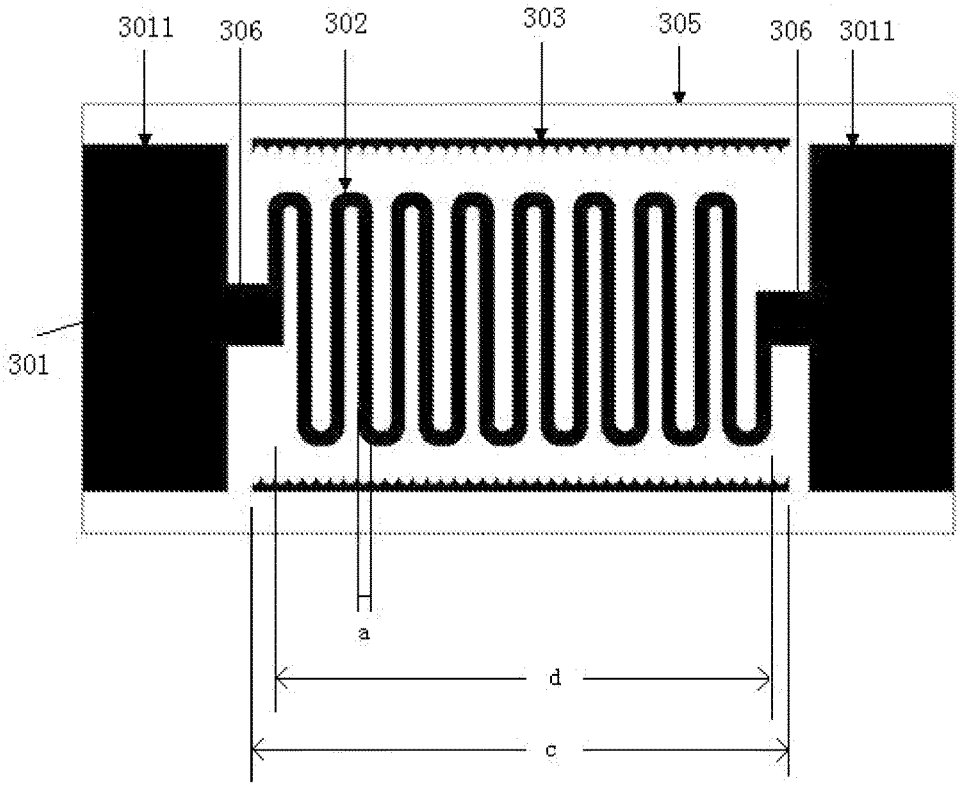
FIG. 13 is another front structure diagram of an insulating substrate in a chip-type protective element.
Figure 14:
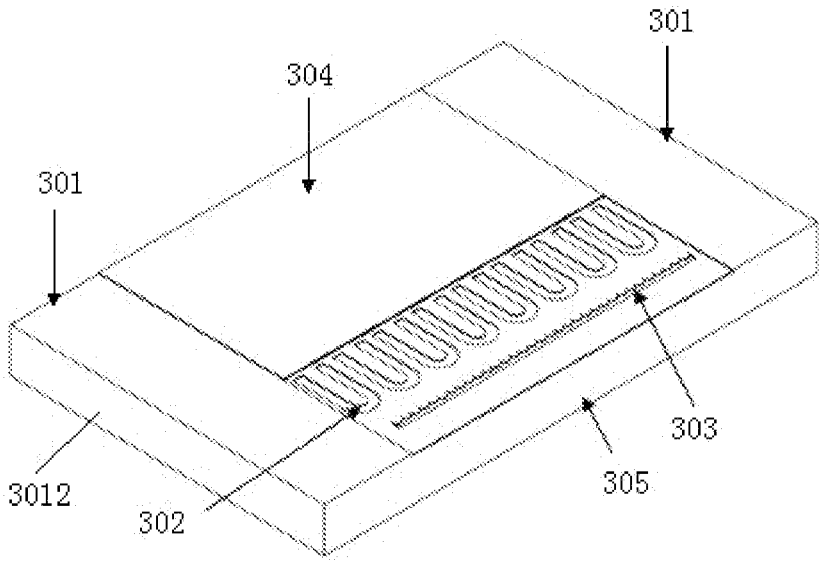
FIG. 14 is a partial split diagram of a chip-type protective element.
Figure 15:
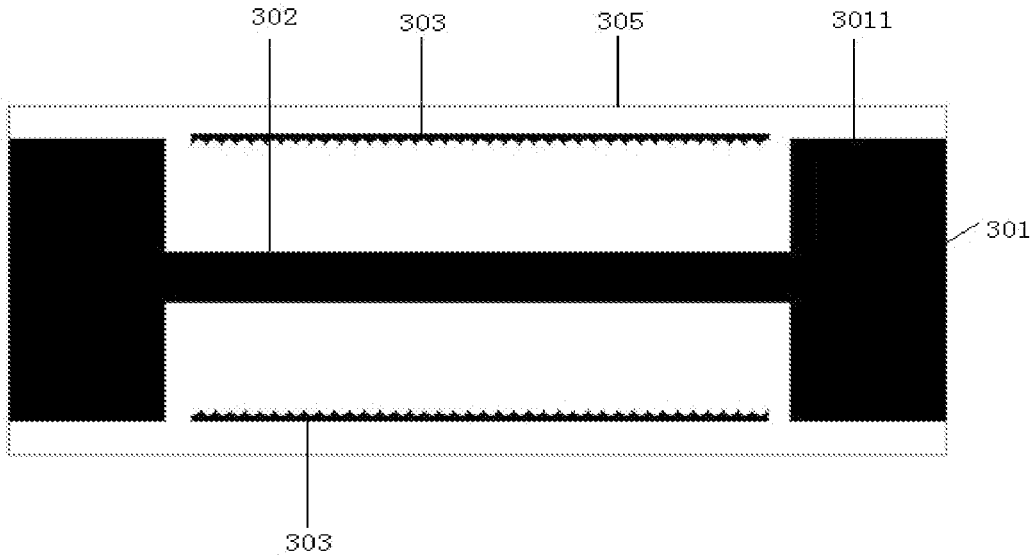
FIG. 15 is a front structure diagram of an insulating substrate in a chip-type protective element having a wave absorbing band and a linear fusible element.

The fusible element 302 is preferably designed by adopting a line corner, and the middle thereof has patterns which are regularly bent and coiled, as shown in FIG. 12. In order to further improve the surge resistance capability of the protective element, the bent corner of the fusible element is designed to be arc-shaped as shown in FIG. 13, so that instantaneous surges can smoothly pass through the fusible element, a bend of the fusible element is difficult to break or fracture. Absolutely, the fusible element may have other usual structures (for example, a linear fusible element shown in FIG. 15) common in the art.

Figure 16:
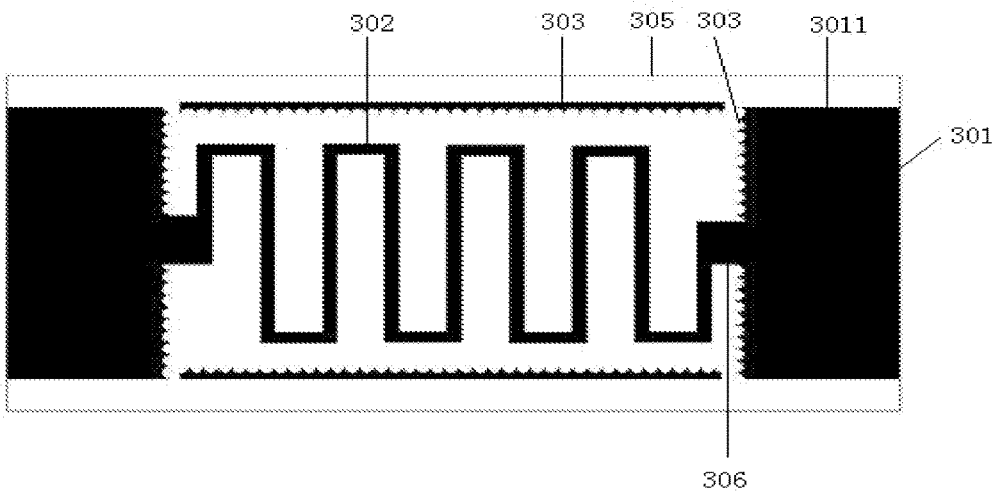
FIG. 16 is a front structure diagram of an insulating substrate in a chip-type protective element having wave absorbing bands on left and right sides of a fusible element.
Figure 17:
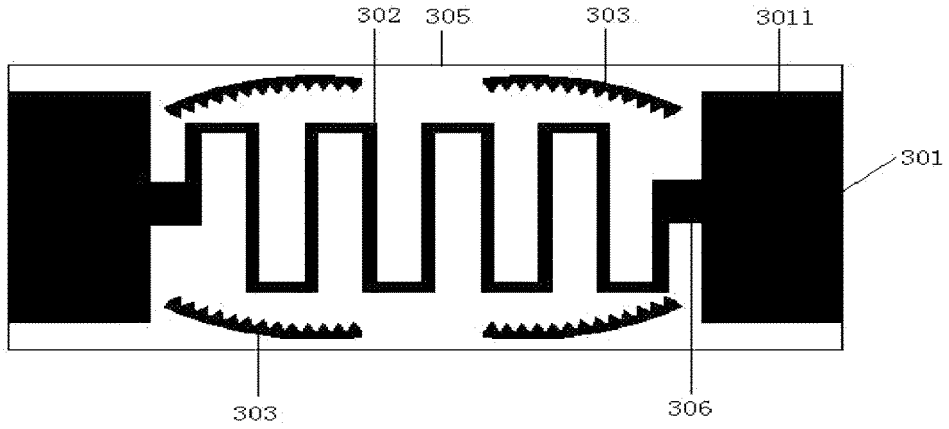
FIG. 17 is a front structure diagram of an insulating substrate in a chip-type protective element having arc-shaped wave absorbing bands at peripheral corners of a fusible element.

The wave absorbing bands 303 can be disposed on an upper side and/or lower side of the fusible element 302 (symmetrically disposed on the upper and lower sides, preferably) as shown in FIG. 12 and FIG. 13, can be disposed on a left side and/or right side of the fusible element 302 (symmetrically disposed on the left and right sides, preferably) as shown in FIG. 16, or can even be disposed at four corners around the fusible element 302 (at the four corners, the wave absorbing bands 303 shall be, preferably, V-shaped or arc-shaped to make the stabs easy to face the fusible element 302, an arc-shaped design mode being shown in FIG. 17). The wave absorbing bands 303 can be disposed at any one or more of these positions simultaneously. When being disposed on the left side and/or right side of the fusible element 302, the wave absorbing bands 303 can be attached to the electrodes (the wave absorbing bands 303 on the left and right sides of the fusible element 302 in FIG. 16 are attached to the electrodes), and can also keep a certain distance away from the electrodes. When the wave absorbing bands 303 are disposed on the upper and lower sides of the fusible element 302, an additional effect can be brought as follows. When the protective element is impacted by indirect lightning surges, even if the fusible element 302 instantaneously fuses off, since two ends of the wave absorbing bands 303 on the upper and lower sides approach the electrodes 3012 on two sides, the indirect lightning surges act on the fusible element 302, air around a high-voltage electrified body is ionized, conductive characteristics will be generated, the wave absorbing bands 303 continue conduction to be electrically connected to the electrodes 3012 on the two sides, currents and voltages of some indirect lightning surges are quickly led to a negative electrode, some energy acting on the fusible element 302 is shunted, and therefore the lightning resistance capability of the entire protective element is at least doubled. When the wave absorbing bands 303 are disposed on the upper and lower sides of the fusible element 302, if the wave absorbing bands 303 are made of insulating materials, the wave absorbing bands can be in contact with the electrodes. However, when being made of metal materials, the wave absorbing bands 303 must keep a certain distance away from the electrodes. The wave absorbing bands 303 are strip-shaped preferably. Two ends of the wave absorbing bands 303 disposed on the upper and lower sides of the fusible element 302 can be bent to the direction of the fusible element 302 to form an encirclement so as to obtain a more stable dispersion effect. Due to the fact that fusing and breaking behaviors may probably occur at any one place of the fusible element 302, the wave absorbing bands 303 shall cover all places where fuse wires are probably broken. When the wave absorbing bands 303 are disposed on the upper and lower sides of the fusible element 302, as shown in FIG. 12 and FIG. 13, transverse lengths c of the wave absorbing bands 303 shall be greater than or equal to lengths d of the patterns of the fusible element 302.

Actually, the wave absorbing bands 303 can be disposed at any space, between the two electrodes, around the fusible element 302. As long as the stabs 3031 facing the fusible element 302 are provided and the stabs 3031 keep a distance away from the fusible element 302, the application requirements of the present invention can be met. If conditions allow, the wave absorbing bands 303 can be disposed in a clearance formed by the fusible element 302 itself, the wave absorbing bands 303 are not in contact with the fusible element 302, certain space is provided between fuse wires bent in the coiled fusible element 302, the wave absorbing bands 303 can be disposed at these places, and the stabs 3031 can be provided on two surfaces of the wave absorbing bands 303 disposed here, thereby generating a dispersion effect to the fuse wires on two sides.

Figure 18:
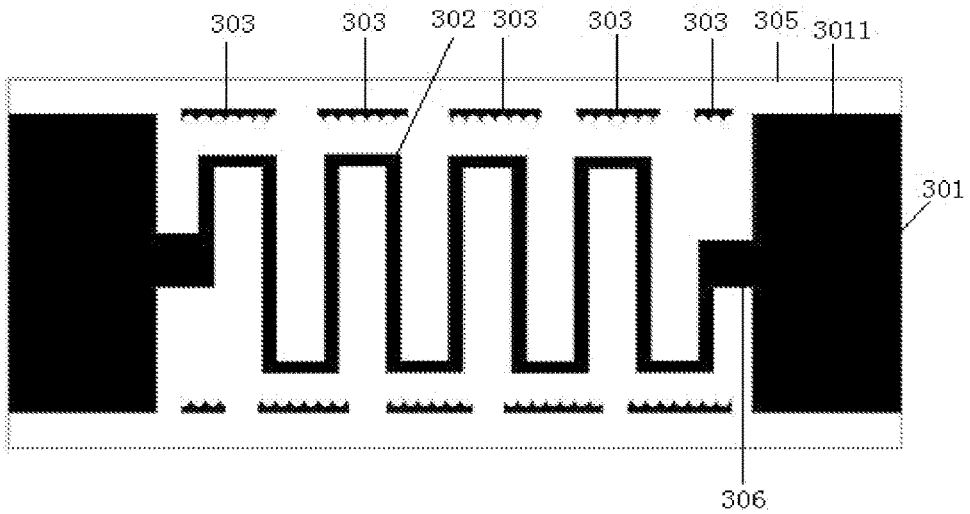
FIG. 18 is a front structure diagram of an insulating substrate in a chip-type protective element having multiple sections of wave absorbing bands.
Figure 19:
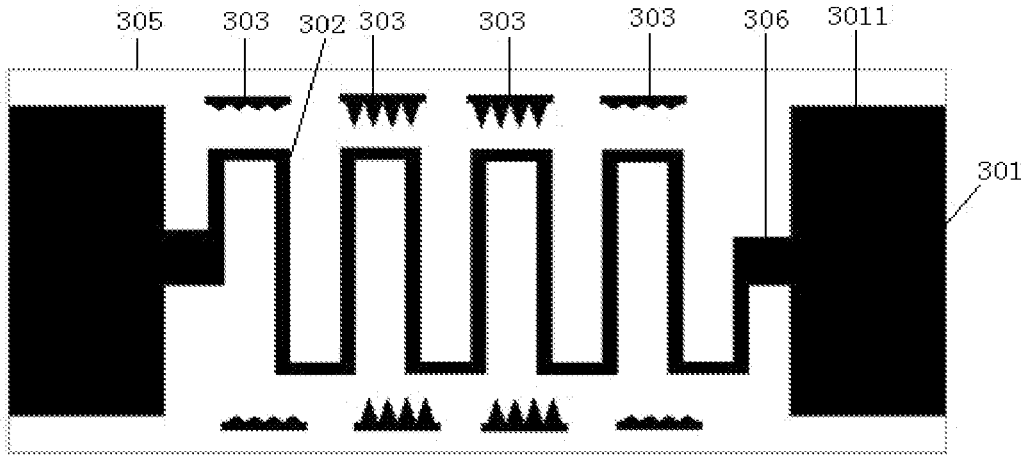
FIG. 19 is a front structure diagram of an insulating substrate in a chip-type protective element having multiple sections of wave absorbing bands and different stab sizes.
Figure 20:
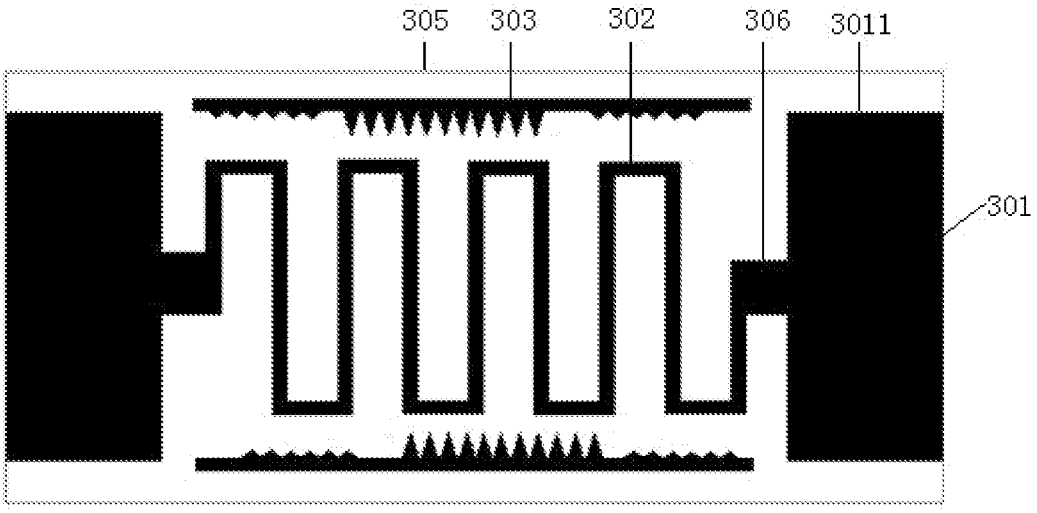
FIG. 20 is a front structure diagram of an insulating substrate in a chip-type protective element having an entire wave absorbing band and different stab sizes.

The wave absorbing bands 303 can be divided into multiple sections. As shown in FIG. 18, the wave absorbing bands 303 on the upper and lower sides of the fusible element 302 are multi-sectional, a certain distance is provided between every two sections, and the stabs 3031 consistent in size are distributed on the wave absorbing bands 303. As shown in FIG. 19, the wave absorbing bands 303 on the upper and lower sides are multi-sectional, and a certain distance is provided between every two sections. The stabs 3031 are distributed on each section of wave absorbing band 303, but the stab 3031 located in the middle of the wave absorbing band 303 is relatively large in size, and the stabs 3031 located at two ends of the wave absorbing band 303 are relatively small in size. This is because the fusible element 302 fuses off from the middle in most circumstances (particularly when the fusible element 302 is coiled). Thus, the breaking energy of the middle of the fusible element 302 is relatively large usually, and the large-size stab 3031 in the middle of the wave absorbing band 303 has a better dispersion effect. As shown in FIG. 20, when the wave absorbing bands 303 on the upper and lower sides of the fusible element 302 are strips, the stabs 3031 thereon can be distributed in a non-uniform manner. In FIG. 20, the size of the stab 3031 located in the middle of the wave absorbing band 303 is relatively large, and the sizes of the stabs 3031 located at two ends of the wave absorbing band 303 are relatively small. It is shown that the stabs 3031 having different sizes and shapes can be provided on the same wave absorbing band 303. In addition, when the wave absorbing bands 303 are disposed on the upper and lower sides simultaneously, the shapes of the stabs 3031 thereof may not be in up-to-down correspondence and shall be suitable for the shape of the fusible element 302 as far as possible, and the same consideration is made when the wave absorbing bands 303 are disposed on the left and right sides simultaneously.

Figure 21:
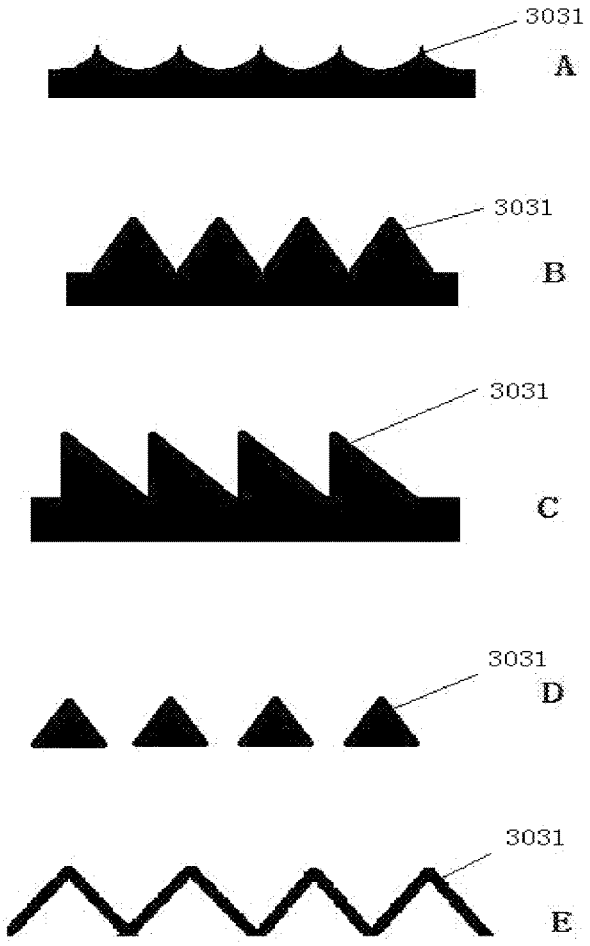
FIG. 21 is a structural example of several wave absorbing bands.

FIG. 21 gives several examples of a structure of a wave absorbing band 303, stabs in the wave absorbing band shown in FIGS. 21(A), (B) and (C) are connected into a whole and are saw-toothed substantially, a valley between two adjacent tooth peaks in FIG. 21(A) is circular arc-shaped, each stab in FIG. 21(B) is shaped like an isosceles triangle, each stab in FIG. 21(C) is shaped like a right triangle, and when the stabs are triangular, a triangle of which the tip is acute angled shall be adopted preferably. The stabs of the wave absorbing band shown in FIG. 21(D) are independent of one another, are not connected into a whole, but are arranged in a column. The wave absorbing band shown in FIG. 21(E) has saw-toothed line profiles, the profiles being hollow internally. It can be seen that the stabs in the wave absorbing bands can vary in multiple shapes. As long as the tips of the stabs are provided and these stabs are uniformly distributed on the wave absorbing bands, the requirements of the present invention can be met, and the stabs can be independent of each other or can be connected into a whole. A test shows that the above five structures can achieve desired effects of the present invention, wherein an effect achieved by a wave absorbing band structure in FIG. 21(A) is optimal. Stabs in multiple shapes can be disposed on a wave absorbing band.

The present invention also provides a manufacturing method for the protective element, comprising the following steps:

Step 1: Take a printed circuit board as an insulating substrate 305, and mount a layer of metal foil (copper foil, preferably) on one surface of the entire insulating substrate 305, the surface on which the metal foil is mounted being a front surface of the insulating substrate.

Step 2: Form a photoresist layer on the metal foil, expose the photoresist layer by virtue of a yellow light process, transfer a photomask pattern to the photoresist layer, reveal the photomask pattern by development, shield fusible element, front electrode and wave absorbing band pattern parts (comprising a fusible element connecting part between a fusible element and a front electrode) needing to be formed, expose a non-pattern area, etch a plurality of groups of needed transverse and longitudinal patterns (fusible element, front electrode and wave absorbing band patterns) on the metal foil, and then remove the photoresist layer, so as to form patterns (comprising the fusible element connecting part between the fusible element and the front electrode) of a fusible element 302, a front electrode and wave absorbing bands 303 distributed on the front surface of the insulating substrate 305 in an array manner.

Step 3: Turn the insulating substrate 305 to a back surface, print a needed back electrode graph on the back surface of the insulating substrate 305 in a screen printing manner, and perform sinter molding. When it is unnecessary to form a back electrode, the step may be omitted.

Step 4: Turn the insulating substrate 305 to the front surface, and print an insulating protection layer 304 between electrodes at two ends of the insulating substrate, wherein the insulating protection layer 304 covers an area (comprising the fusible element connecting part between the fusible element and the front electrode) over the fusible element 302 and the wave absorbing bands 303, and does not cover a part insulating the front electrode.

Step 5: Cut the whole insulating substrate into strips, arrange side edges in order, sputter a metal layer to the side edges as side electrodes configured to be connected to the front electrode and the back electrode, cut the strip-shaped insulating substrates into final granular protective element products, add a coating layer to the front electrode, the back electrode and the side electrodes in a surface treatment manner, and integrally form electrode parts 301 so as to complete manufacturing of protective element products. When it is unnecessary to form the back electrode, the side electrodes are only connected to the front electrode, and the coating layer only needs to cover the front electrode and the side electrodes to form the electrode parts 301.

The novel protective element products, with the wave absorbing bands, manufactured by means of the above method can at least double breaking performances and lightning resistance performances of a small-sized protective element. For example, in accordance with an existing designed structure, a chip-type fuse of which the size is 6.4 mm×3.25 mm×0.75 mm and the rated current is 2 A cannot bear a voltage higher than 220V, can be used in only a direct current (DC) circuit, can achieve a breaking capability of only 125V/50 A DC, and can achieve a lightning surge resistance capability of only 0.5 KV. The novel protective element which is prepared in the present invention and has the same size and the rated current of 2 A can achieve a breaking capability of 250V/100 A alternating current (AC) or 250V/100 A DC, and the lightning surge resistance capability is improved to 1 KV.

Embodiment 4

Figure 22:
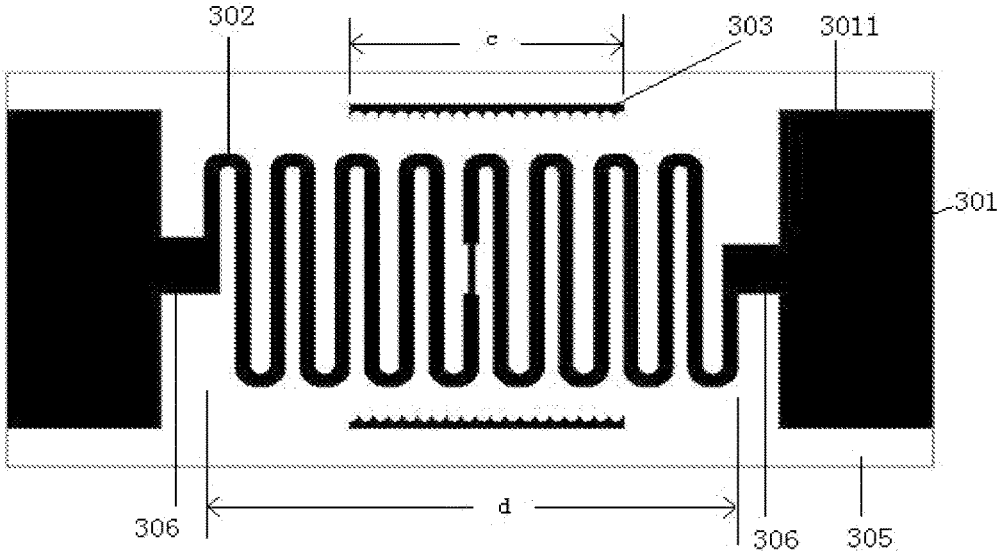
FIG. 22 is a front structure diagram of an insulating substrate in a protective element provided by embodiment 4.

As an improvement of embodiment 3, as shown in FIG. 22, in order to further improve a breaking performance of a protective element, when a pattern of a fusible element 302 is designed, the central section is set as a thin fusible element having a smaller width, so that behaviors of fusing, breaking and the like are guided to be started from the middlemost of the fusible element, and the behaviors will not deflect to two sides entirely. In this case, the lengths of wave absorbing bands on upper and lower sides can be correspondingly reduced, c is probably more than half of a transverse length d of the pattern of the fusible element, the centers of the two wave absorbing bands correspond to the center of the fusible element, the centers of the two wave absorbing bands and the center of the fusible element are overlapped in a vertical direction, that is, the wave absorbing bands and the fusible element are on a straight line. Other structural features of the protective element in the present embodiment are the same as those in embodiment 1, and a manufacturing method for the protective element is the same as that in embodiment 3.

Embodiment 5

As an improvement of embodiment 3 or embodiment 4, a ceramic substrate is adopted as an insulating substrate in the present embodiment. Since the ceramic substrate is relatively high in hardness, cannot be well bonded with a metal foil layer and is relatively good in heat conductivity in a using process, heat insulation fixed layers are provided between the ceramic substrate and a fusible element, between the ceramic substrate and wave absorbing bands and between the ceramic substrate and a front electrode 3011. The heat insulation fixed layers are preferably made of polyimide (PI) materials, so that the bonding property between the metal foil and the ceramic substrate can be improved, the effects of heat insulation and heat preservation are achieved, and the fusing stability is improved. Other technical features of a protective element in the present embodiment are the same as those in embodiment 1 or embodiment 2.

Correspondingly, when the protective element is manufactured, it is necessary to additionally mount a heat insulation fixed layer before the metal foil is mounted on the ceramic substrate in Step A of the method in embodiment 1, and other manufacturing steps are the same as those in embodiment 1.

Embodiment 6

The present embodiment provides another production method for a protective element, comprising the following steps:

Step 1: Print a plurality of groups of transverse and longitudinal patterns (comprising a fusible element connecting part between a fusible element and a front electrode) of a fusible element 302, a front electrode and wave absorbing bands 303 on a front surface of an entire insulating substrate 305 using metal slurry in a screen printing manner, and form an array graph, wherein the metal slurry is silver slurry preferably, and the insulating substrate 305 may be made of a ceramic material or may be a printed circuit board.

Step 2: Print an array graph of a back electrode in a screen printing manner after surface turning, and perform sinter molding. When it is unnecessary to form the back electrode, the step may be omitted.

Step 3: Print an insulating protection layer 304 between electrodes at two ends of the insulating substrate 305 in a screen printing manner, wherein the insulating protection layer 304 covers an area (comprising the fusible element connecting part between the fusible element and the front electrode) over the fusible element 302 and the wave absorbing bands 303, and does not cover a part insulating the front electrode.

Step 4: Cut the entire insulating substrate into strips, longitudinally distribute a plurality of intermediate products of protective elements on each strip-shaped insulating substrate, arrange side edges of each strip-shaped insulating substrate in order, sputter a metal layer to the side edges of two ends of the substrate as side electrodes configured to be connected to the front electrode and the back electrode, cut the strip-shaped insulating substrates into final granular protective element products, add a coating layer to the front electrode, the back electrode and the side electrodes in a surface treatment manner, and integrally form electrode parts 301 so as to accomplish the protective elements. When it is unnecessary to form the back electrode, the side electrodes are only connected to the front electrode, and the coating layer only needs to cover the front electrode and the side electrodes to form the electrode parts 301.

The method in the present embodiment is applicable to manufacturing of the protective elements having the structures in embodiment 3, embodiment 4 and embodiment 5.

It should be noted that an overall proportion of wave absorbing structures to a protective element, in the figures, only serves as a schematic reference, and shall not limit the present invention. According to the size of an actual product, the size of a cavity and the thickness of a fusible element, the sizes of protrusion parts on the wave absorbing structures can be adjusted as needed.

The technical means disclosed in the solution of the present invention is not limited to the technical means disclosed in the above implementations, but also comprises the technical solution constituted by randomly combining the above technical features. It shall be pointed out that those skilled in the art can make several improvements and polishes without departing from the principle of the present invention. These improvements and polishes are regarded as falling within the protective scope of the present invention.

What is claimed is:

1. A protective element, comprising an insulator, a fusible element and electrodes, the insulator covering the fusible element of which a part is meltable, the electrodes being disposed at two ends of the insulator and each electrode covering a portion of both an upper surface and a lower surface of the insulator, two ends of the fusible element being electrically connected to the electrodes, and wherein wave absorbing structures are disposed around the fusible element in the insulator and comprise a plurality of protrusions surrounding all sides of the insulator and are formed on an inner surface of the insulator, the protrusions face the fusible element and distances exist between each protrusion and the fusible element, wherein the protrusions disperse energy waves and heat impact generated during breaking of the fusible element, and wherein the protrusions have tapered shapes with tips where the tips face the fusible element, wherein the protrusions further comprise a plurality of metal coating layers formed on the plurality of protrusions.

2. The protective element according to claim 1, wherein a cavity is provided in the insulator, the meltable part in the fusible element is suspended in the cavity, the plurality of protrusions are disposed on an inner wall of the cavity, top ends of the protrusions face the fusible element, and distances exist between the protrusions and the fusible element.

3. The protective element according to claim 2, wherein the protrusions are conical, truncated cone-shaped, cylindrical, prismatic or cuboid-shaped.

4. The protective element according to claim 2, wherein the protrusions close to the middle of the cavity are larger than the protrusions close to two ends of the cavity.

5. The protective element according to claim 1, wherein the insulator is a tubular housing.

6. The protective element according to claim 1, wherein the tapered shapes are conical.

7. The protective element according to claim 1, wherein the tapered shapes are pyramidal.

8. The protective element according to claim 1, wherein the tapered shapes are prism shaped.

9. The protective element according to claim 1, wherein the tapered shapes are truncated cones.

10. The protective element according to claim 1, further comprising a cavity provided in the insulator and wherein the protrusions close to the middle of the cavity are larger than the protrusions close to two ends of the cavity.

* * * * *